United States Patent [19]

Wilmoth et al.

[11] 3,938,803

[45] Feb. 17, 1976

[54] DUAL PURPOSE EXERCISING DEVICE

[76] Inventors: Robert B. Wilmoth; Warren J. Wilmoth, both of 3802 Bobbie Lane, Garland, Tex. 75042

[22] Filed: Aug. 1, 1974

[21] Appl. No.: 493,581

[52] U.S. Cl. ..... 272/57 J; 272/67; 272/83 R

[51] Int. Cl.[2] ..... A63B 21/22; A63B 23/02

[58] Field of Search ..... 272/83 R, 57 J, 67, 68, 272/88

[56] References Cited

UNITED STATES PATENTS

| | | | |
|---|---|---|---|
| 818,242 | 4/1906 | Geisel | 272/83 R |
| 2,920,418 | 1/1960 | Britt | 272/67 X |
| 3,403,906 | 10/1968 | Burzenski | 272/57 J |

FOREIGN PATENTS OR APPLICATIONS

| | | | |
|---|---|---|---|
| 25,034 | 12/1899 | United Kingdom | 272/84 |
| 9,899 | 4/1909 | United Kingdom | 272/83 R |

*Primary Examiner*—Paul E. Shapiro
*Attorney, Agent, or Firm*—Howard E. Moore; Gerald G. Crutsinger

[57] ABSTRACT

A dual purpose exercising device comprised of a bar with hand grips on the outer ends. Wheeled handles are slidably disposed on the bar and are abutted against the hand grips. A spring is disposed about the bar between the wheeled handles to urge them outwardly. The wheeled handles may be moved inwardly against the spring for compression exercising; the wheeled handles acting as wheels for using the device as a roller exerciser.

1 Claim, 3 Drawing Figures

DUAL PURPOSE EXERCISING DEVICE

BACKGROUND OF INVENTION

Heretofore, no economical and simple device has been devised to allow multiple types of exercises. Many devices provide more than one exercise but are bulky and relatively expensive.

Our society suffers from overweight. We do not get the proper exercise to trim the excessive weight we gain from our bodies, which is a major cause of heart attacks, the primary cause of death in our country.

One reason many people do not exercise is the cost involved for the equipment to exercise with.

Another factor involved is the time and space needed to exercise with presently available exercising devices. Running requires a great deal of time and space to keep stomach muscles in condition. For a good physique, one must keep his chest and arms in condition which usually requires lifting weights, involving the purchase of relatively expensive equipment.

SUMMARY OF INVENTION

We have provided a dual purpose exercising device comprising two wheeled handles slidably disposed on a bar between hand grips rigidly attached to the ends of the bar. A spring is slideably disposed on the bar between the wheeled handles so that when the user presses inwardly on the wheeled handles he must apply sufficient force to compress the spring. The two wheeled handles act as wheels rotatably and slideably disposed on the bar so that when the user grips the stationary hand grips he may roll the device while in a prone position.

A primary object of our invention is to provide an inexpensive means of keeping the body trim and fit.

A further object of our invention is to allow the user to perform multiple exercises with a single exercising device.

Another object of our invention is to provide a method of keeping the arm and chest muscles in condition with a minimum amount of effort and expense.

A still further object of our invention is to provide means to keep the stomach and back muscles in condition with a minimum of effort, space, and time consumed.

A general object of the invention is to provide a relatively inexpensive, compact exercising device which has a multiplicity of uses and applications.

Other and further objects of my invention will become apparent upon referring to the detailed description hereinafter following and to the drawings annexed hereto.

DESCRIPTION OF DRAWINGS

Drawings of a preferred embodiment of the invention are annexed hereto so the invention may be better and more fully understood, in which.

Numeral references are employed to designate like parts throughout the various figures of the drawing.

DESCRIPTION OF A PREFERRED EMBODIMENT

Figure 1:
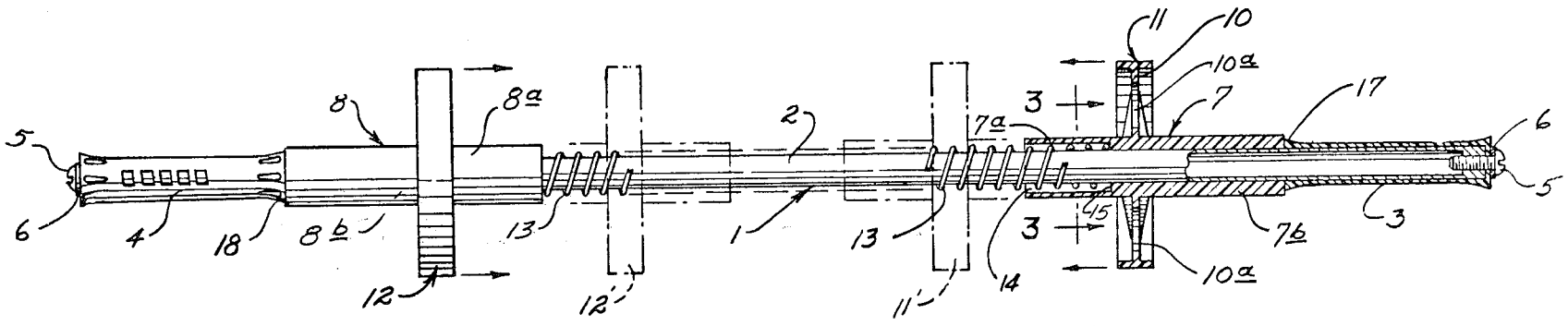
FIG. 1 is a partially sectionalized elevational view of the dual purpose exercising device.
Figure 3:
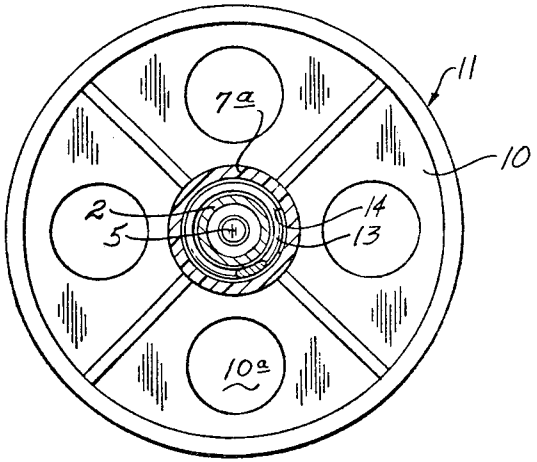
FIG. 3 is a cross-sectional view taken along line 3-3 of FIG. 1.
Figure 2:
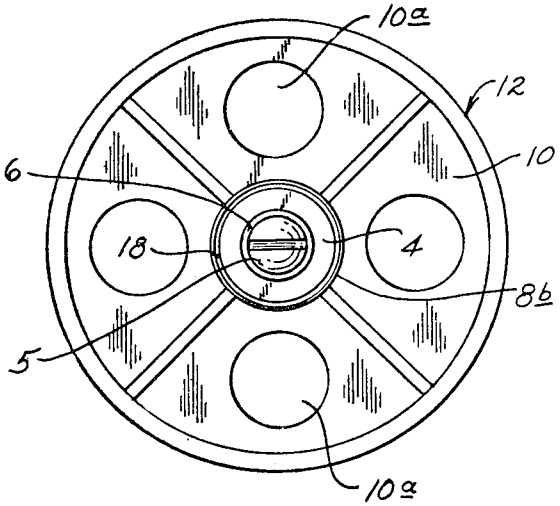
FIG. 2 is an end elevational view of FIG. 1.

Referring to FIG. 1, the numeral 1 generally designates a dual purpose exercising device.

The exercising device 1 generally comprises a bar 2 with hand grips 3 and 4 disposed at both ends thereof, and preferably held in place by screw 5 and washer 6 or they may be held in place by friction. The hand grips 3 and 4 are preferably comprised of non-slip material such as molded plastic, or the like and are preferably shaped and dimensioned so as to accommodate the hands of the user gripped about grips 3 and 4 when using it as a rolling exerciser in the manner hereinafter described.

The interior ends of hand grip 3 and 4 provide shoulders 17 and 18 against which is urged wheeled grips 7 and 8 by spring 13. Wheeled grips 7 and 8 have a bore extending longitudinally therethrough, through which bar 2 is slidably disposed, so that the wheeled grips are rotatable thereabout. Outer webs 10 support the rims of wheels 11 and 12 and add structural strength to allow the exercising device 1 to be used as a rolling exerciser.

Spring 13 is slideably disposed about bar 2, between hollow inner end extensions 7*a* and 8*a* on wheeled grips 7 and 8, and extends into counterbore 14 in each of the extensions 7*a* and 8*a*. Counterbore 14 has a diameter larger than that of spring 13, allowing the spring 13 to enter counterbore 14. Hollow outer extensions 7*b* and 8*b* on wheeled grips 7 and 8 provide grips to accommodate the hands of the user.

The spring 13 has ends abutted against shoulders 15 in counterbore 14 so that the spring is disposed between the two wheeled grips 7 and 8, thereby allowing compression of spring 13 when the wheeled grips 7 and 8 are moved inwardly thereover, as illustrated by broken lines in FIG. 1.

It should be readily apparent that springs 13 of varying compression or a multiplicity of such springs may be substituted in the device to thereby vary the effectiveness of the exerciser.

The operation and function of the device heretofore described is as follows:

The use as a rolling device, the exercising device 1 is gripped about handles 3 and 4 while the user is in a standing position. Bending at the waist the user positions the wheels 11 and 12 onto the floor adjacent his feet. The user then extends his body, keeping his feet stationary and rolling the wheels 11 and 12, which are independently rotatable about bar 2, across the floor away from his feet.

It should be readily apparent that stomach and chest muscles will be stretched as the exercising device is moved across the floor when the weight of the user is supported by his feet and the exercising device.

When used as a compression device to exercise the arm muscles and chest, outer extensions 7*b* and 8*b* of wheeled grips 7 and 8 are gripped. The wheeled grips are pushed inwardly along bar 2 to the position 11′ and 12′, shown in broken lines in FIG. 1, compressing spring 13 between the wheeled grips thereby exercising the muscles in the arms and chest. As external force exerted on the wheeled grips 7 and 8 is slowly released spring 13 urges wheeled grips 7 and 8 into engagement with shoulders 17 and 18 on hand grips 3 and 4.

It will be understood that other and further embodiments of the device may be devised without departing from the spirit and scope of the appended claims.

Having described our invention, we claim:

1. An exercise device comprising: an elongated cylindrical bar having a smooth outer surface; a pair of hand grips; an abutment on each of said hand grips, one of said hand grips being secured to each end of said bar such that each of said abutments is positioned intermediate opposite ends of said bar; a pair of tubular sleeves having inner and outer ends, each of said sleeves having a bore extending therethrough, said bar being telescopically disposed in said bores, each of said sleeves having an enlarged counterbore formed in inner ends thereof, said bore and counterbore in each of said sleeves being concentric forming a shoulder inside each of said tubular sleeves intermediate opposite ends of said sleeves; a coiled spring having a central passage, said bar extending through said central passage, said spring having ends extending into said counter bores and into abutting relation with said shoulders such that an outer end of each of said sleeves is urged into engagement with one of said abutments on said hand grips secured to opposite ends of said bar; a pair of wheels; and means rigidly securing one of said wheels to each of said sleeves, each of said wheels being spaced from the outer end of each of said sleeves to provide an extension between the outer end of each of said sleeves and each of said wheels, said extensions being adapted to be gripped by human hands to urge said sleeves inwardly along said bar to move outer ends of said sleeves out of engagement with said abutments on said hand grips on opposite ends of the bar.

* * * * *